US011117383B2

(12) United States Patent
White et al.

(10) Patent No.: US 11,117,383 B2
(45) Date of Patent: Sep. 14, 2021

(54) CONSUMABLE STORAGE

(71) Applicant: Hewlett-Packard Development Company, L.P., Spring, TX (US)

(72) Inventors: Bradley Spencer White, Boise, ID (US); Daniel Scott Ellis, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 3 days.

(21) Appl. No.: 16/498,922

(22) PCT Filed: Apr. 4, 2017

(86) PCT No.: PCT/US2017/025879
§ 371 (c)(1),
(2) Date: Sep. 27, 2019

(87) PCT Pub. No.: WO2018/186834
PCT Pub. Date: Oct. 11, 2018

(65) Prior Publication Data

US 2020/0114654 A1 Apr. 16, 2020

(51) Int. Cl.
*B41J 2/175* (2006.01)
*B41L 27/04* (2006.01)

(52) U.S. Cl.
CPC ..... *B41J 2/17546* (2013.01); *B41L 27/04* (2013.01)

(58) Field of Classification Search
CPC ..... B41J 2/17546; B41L 27/04
See application file for complete search history.

(56) References Cited

U.S. PATENT DOCUMENTS 5,508,795 A * 4/1996 Kikuchi ..... G03G 21/1814 399/262
6,310,692 B1 10/2001 Fan et al.
7,660,539 B2 2/2010 Tye et al.
8,511,120 B2 8/2013 Cahill et al.
8,714,685 B2 * 5/2014 Fujinaga ..... G06K 15/021 347/16

(Continued)

FOREIGN PATENT DOCUMENTS

CN 102616019 8/2012
CN 102958490 3/2013

(Continued)

OTHER PUBLICATIONS

Marvell Introduces Consumable Security Chip Using Cryptography Research's CryptoFirewall Anti-counterfeiting Technology~http://www.marvell.com/ ~ Feb. 2013 ~ 2 pages.

*Primary Examiner* — Huan H Tran
(74) *Attorney, Agent, or Firm* — HP Inc. Patent Department

(57) ABSTRACT

An example system includes an imaging device and a consumable storage unit. The imaging device includes at least one consumable used in operation of the imaging device and a controller. The consumable storage unit includes at least one cavity to store a replacement consumable therein. The replacement consumable is inaccessible for use in operation of the imaging device. The controller is communicatively coupled to the consumable storage unit to receive a signal indicative of presence or absence of replacement consumable in the consumable storage unit.

20 Claims, 3 Drawing Sheets

(56) References Cited

U.S. PATENT DOCUMENTS

| | | | | |
|---|---|---|---|---|
| 8,905,504 | B2 * | 12/2014 | Iizawa | B41J 2/17566 347/7 |
| 9,278,539 | B2 * | 3/2016 | Saka | B41J 2/175 |
| 10,353,645 | B2 * | 7/2019 | DeFore | G06F 3/1205 |
| 2005/0108224 | A1 | 5/2005 | Silverbrook et al. | |
| 2013/0003104 | A1 * | 1/2013 | DeFore | G06F 3/1271 358/1.14 |
| 2014/0104347 | A1 | 4/2014 | Iizawa | |
| 2014/0218433 | A1 | 8/2014 | Fujinaga | |
| 2020/0198357 | A1 * | 6/2020 | Schmidt | G03G 15/0865 |
| 2020/0346465 | A1 * | 11/2020 | Schmidt | B41J 2/175 |

FOREIGN PATENT DOCUMENTS

| | | | |
|---|---|---|---|
| CN | 203254794 | | 10/2013 |
| CN | 104647912 | | 5/2015 |
| EP | 2328130 | A1 | 6/2011 |
| JP | 2016032889 | A | 3/2016 |

* cited by examiner

CONSUMABLE STORAGE

BACKGROUND

Imaging system, such as printers, typically include ink cartridges that are used for depositing ink onto print media such as paper. The ink cartridges contain a limited amount of ink. Once the ink in an ink cartridge is depleted, the ink cartridge can be replaced. The depleted ink cartridge can be removed and a replacement ink cartridge can be inserted.

BRIEF DESCRIPTION OF THE DRAWINGS

For a more complete understanding of various examples, reference is now made to the following description taken in connection with the accompanying drawings in which.

DETAILED DESCRIPTION

Various examples described herein relate to storage of consumables for imaging systems, such as printers. A storage unit may be provided in communication with a controller (e.g., firmware) of an imaging system. The storage unit can store consumables, such as ink cartridges, toner cartridges or paper, which may be accessible by a user. The storage unit may include sensors to detect whether or not consumables are stored therein. In various examples, access to the storage unit is controlled by or through the controller of the imaging system. For example, the storage unit may include lockable doors which are opened by signals from the controller. Thus, consumables may be stored in proximity of the imaging system in a secure and trackable manner.

As noted above, ink cartridges for various imaging systems, such as printers, need to be replaced when depleted. The same may be the case for other consumables also, such as paper, for example. In some office environments, replacement ink cartridges may be stored at a location, such as a storage closet, requiring a user to leave the immediate area of the printer to retrieve the replacement ink cartridge. In other office environments, replacement ink cartridges may be provided in the region of the printer, but this leaves the replacement cartridges open to theft. Further, in an environment with multiple printers, tracking of the use of the ink cartridges (e.g., which printer is using the replacement cartridges) becomes difficult or impossible. Various examples described herein allow for secure, proximate and trackable storage of the replacement cartridges or other consumables.

Figure 1:
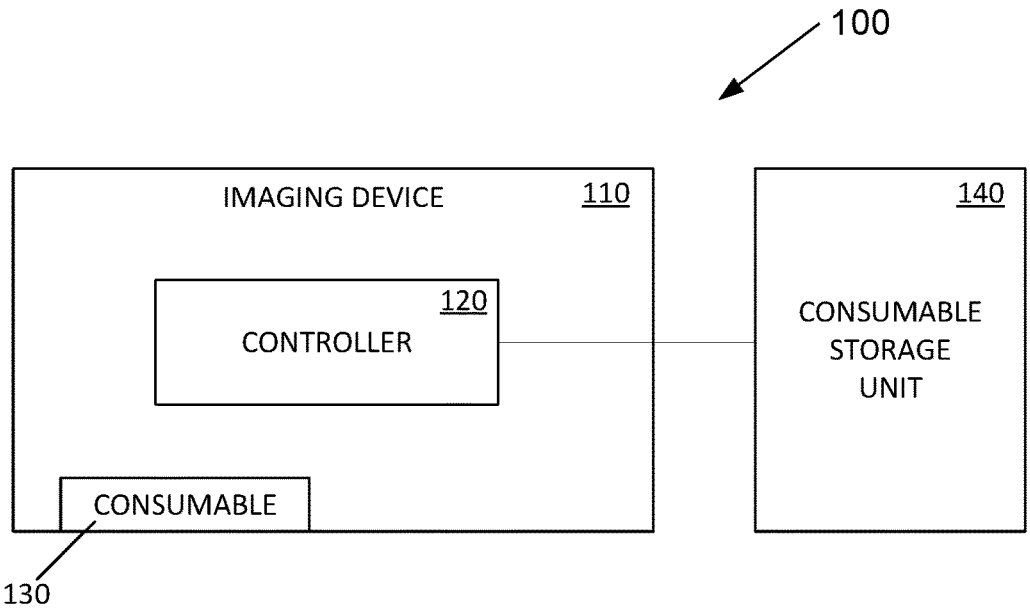
FIG. 1 provides a schematic illustration of an example system with consumable storage.

Referring now to FIG. 1, an example system for storage of consumables is illustrated. The example system 100 of FIG. 1 includes an imaging device 110. In various examples, the imaging device 110 may be a printer, copier, fax machine or a multi-function device, for example. In this regard, the imaging device 110 may include various subsystems and components not shown in FIG. 1. For example, in various examples, the imaging device 110 may include a media input (e.g., paper tray), a media intake portion, an image forming portion and a media output portion. Various examples may include additional or fewer subsystems and components.

The imaging device 110 of the example system of FIG. 1 includes a controller 120. The controller may be implemented in various examples as software, hardware, firmware or a combination thereof. In various examples, the controller 120 may control and coordinate operation of the image device 110. In this regard, the controller 120 may, for example, actuate the media intake portion to cause a print media to be transported from the media input to the image forming portion or to cause the image forming portion to form an image on the print media. The controller 120 may further communicate with an external device, such as a desktop, laptop, tablet, smart phone or the like, through a communication interface of the example imaging device 110. For example, the controller 120 may receive a print request from a user's laptop or smartphone and process the request through control of the various subsystems of the example imaging device 110.

The imaging device 110 is provided with at least one consumable 130 that may be used in operation of the imaging device. As noted above, the consumable 130 may include one or more ink cartridges, laser toner cartridge or paper, for example. In one example, the imaging device is a color inkjet printer, and the consumable 130 includes four ink cartridges (black, cyan, magenta and yellow). In another example, the imaging device is a three-dimensional printer, and the consumable is a filament spool or a binder cartridge. Of course, various other types of consumables are possible and are contemplated within the scope of the present disclosure.

The example system 100 of FIG. 1 includes a consumable storage unit 140. The consumable storage unit 140 includes at least one cavity in which a replacement consumable may be stored. For example, the consumable storage unit 140 may store one or more ink cartridge or laser toner cartridge in a cavity. Accordingly, the cavity may be sized to accommodate a consumable associated with the imaging device 110, for example. The consumable stored in the cavity of the consumable storage unit 140 may be a replacement consumable for the consumable 130 of the imaging device 110. Accordingly, the replacement consumable in the cavity of the consumable storage unit 140 is inaccessible for use in operation of the imaging device 110. For example, while the replacement consumable is stored in the cavity of the consumable storage unit 140, the imaging device 110 is unable to use the stored replacement consumable.

As illustrated in the example of FIG. 1, the controller 120 of the example imaging device 110 is communicatively coupled to the consumable storage unit 140. In various examples, the controller 120 may communicate with the consumable storage unit 140 through a wired connection (e.g., universal serial bus (USB) or direct cable) or a wireless connection (e.g., WiFi, Bluetooth, Near-field communication (NFC)).

In various example, the controller 120 of the example imaging device 110 communicates with the consumable storage unit 140 to receive a signal from the consumable storage unit 140. The signal may be indicative of the presence or absence of a replacement consumable in the consumable storage unit 140. For example, the consumable storage unit 140 may include a sensor which senses when a replacement consumable is stored in a cavity of the consumable storage unit 140. The sensor may cause a signal to be generated and transmitted to the controller 120 of the imaging device 110. Thus, the controller 120 of the imaging device 110 may determine whether a replacement consumable is available in the consumable storage unit 140.

Figure 2:
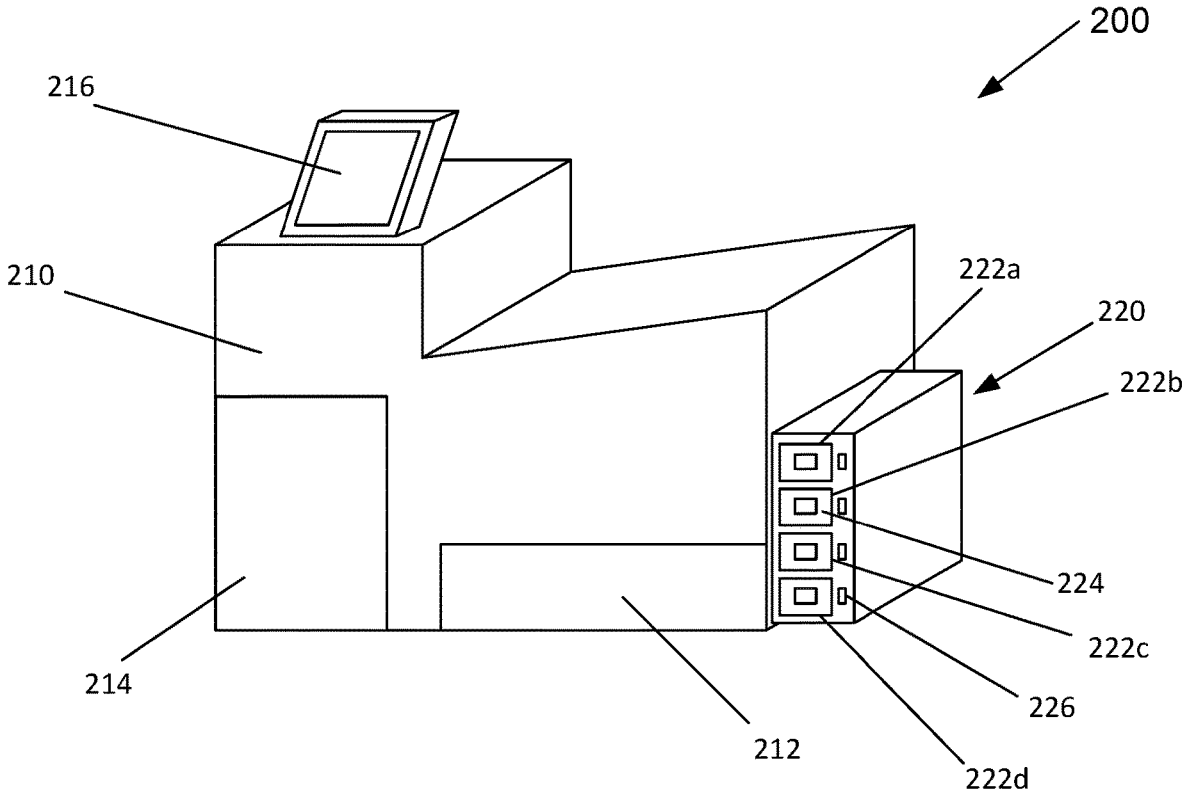
FIG. 2 illustrates another example system with consumable storage.

Referring now to FIG. 2, another example system with consumable storage is illustrated. The example system 200 of FIG. 2 includes an imaging device 210 which may be a printer, copier, fax machine or a multi-function device, for example. In the example of FIG. 1, the imaging device 210 is provided with a paper try 212 which may include a stack of paper from which the imaging device 210 can pull paper on which to print, for example. The imaging device 210 further includes an ink cartridge access panel 214. In various examples, when an ink cartridge is depleted, a user can open the ink cartridge access panel 214 to remove the depleted cartridge and insert a new cartridge.

In the example system 200 of FIG. 2, the imaging device 210 is provided with a user interface 216 to allow a user to provide inputs to and receive outputs from the imaging device 210. In various examples, the user interface 216 may include a small display (e.g., liquid crystal display) and a keypad. In other examples, as illustrated in FIG. 2, the user interface 216 includes a touch screen to allow the user to select icons, for example, to provide inputs to the imaging device 210.

The examples system 200 of FIG. 2 further includes a consumable storage unit 220. As noted above, the consumable storage unit 220 may be used to store one or more ink cartridge, laser toner cartridge or other consumable for the imaging device 210. In the example of FIG. 2, the consumable storage unit 220 includes four storage slots 222*a-d*. Each storage slot 222*a-d* may be sized to accommodate, for example, an ink cartridge that is usable by the imaging device 220, for example.

Each storage slot 222*a-d* of the example consumable storage unit 220 includes a cavity that is accessible through a door 224. The door 224 may be lockable such that access to the contents of each cavity is restricted. Thus, a replacement cartridge stored in one of the storage slots 222*a-d* can only be accessed with proper authorization. In the example of FIG. 2, the consumable storage unit 220 is provided with an indicator 226 corresponding to each storage slot 222*a-d*. The indicator 226 may be a light, such as a light-emitting diode, which indicates the presence or absence of a replacement cartridge in the corresponding storage slot 222*a-d*. In one example, the indicator 226 may be off in the absence of a replacement cartridge and on in the presence of one. In another example, the indicator 226 may change colors, for example, from red in the absence of a replacement cartridge to green in the presence of one.

In various examples, access to the storage slots 222*a-d* may be controlled by a controller (e.g., firmware) of the imaging device 210. For example, a user, such as a system administrator, may provide proper credentials to authorize the controller to unlock and open one or more doors 224 of the storage slots 222*a-d*. In one example, the user may provide the proper credentials or input to the user interface 216 of the imaging device. In another example, the user may interface with the imaging device 210 through another device.

Figure 3:
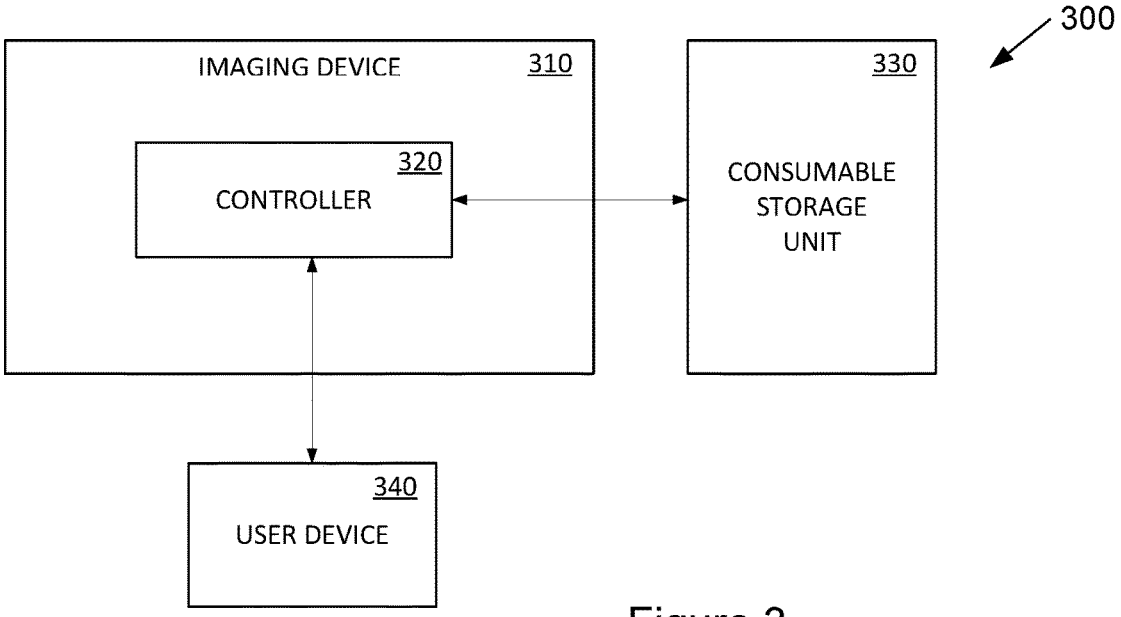
FIG. 3 illustrates an example system to allow user access to a consumable storage unit.

For example, FIG. 3 illustrates an example system 300 to allow user access to a consumable storage unit through another device. In the example system 300 of FIG. 3, an imaging device 310 includes a controller 320, as described above with reference to FIG. 1. As noted above, the controller 320 may be implemented as hardware, software, firmware, or a combination thereof. Further, the example system 300 includes a consumable storage unit 330, which may be similar to the consumable storage unit 220 described above with reference to FIG. 2. In this regard, the consumable storage unit 330 may include storage slots that are accessible through a lockable door.

In the example of FIG. 3, the controller 320 of the imaging device 310 is in communication with a user device 340. In various examples, the controller 320 may be directly connected with the user device 340 through, for example a wired connection (e.g., Ethernet, USB, etc.) or a wireless connection (e.g., NFC, Bluetooth, etc.). In other examples, the communication between the controller 320 and the user device 340 may be through a network, such as a wide-area network (e.g., Internet) or a local-area network. Further, the example user device 340 may be any of a variety of electronic devices, such as desktop, laptop, tablet, smart phone or the like.

In various examples, a user may obtain various information through interfacing with the controller 320. For example, a user may be able to determine the level of consumables remaining in the imaging device 310. For example, a user may access how much ink is remaining in each of black, cyan, magenta and yellow ink cartridges presently in use by the imaging device 310. Further, the user may be able to determine what consumables are presently stored in the consumable storage unit 330. For example, the user may access the identity of the contents of the various storage slots of the consumable storage unit. For example, each storage slot may include a sensor to determine the presence or absence of a replacement consumable in the slot. In some examples, the sensor may include, for example, a bar code reader which can identify the type of replacement consumable currently in each slot. For example, the sensor may identify whether the replacement cartridge is a black, cyan, magenta or yellow ink replacement cartridge.

In various examples, access to the storage slots of the consumable storage unit 330 may be limited to a system administrator. In this regard, the system administrator may monitor and control use of the replacement consumables at one or multiple imaging devices in an office environment. For example, a replacement consumable may only be accessed when a system administrator provides sufficient and proper credentials to open a door of a storage slot.

In various examples, a consumable storage unit may be integrally formed with the imaging device. For example, as illustrated in FIG. 2, the consumable storage unit 220 may be integrally formed and attached to the imaging device 210. In other examples, a consumable storage unit may be provided as a stand-alone accessory. In this regard, the consumable storage unit may be placed in proximity to, but not attached to, the imaging device for easy access to the replacement consumables.

Figure 4:
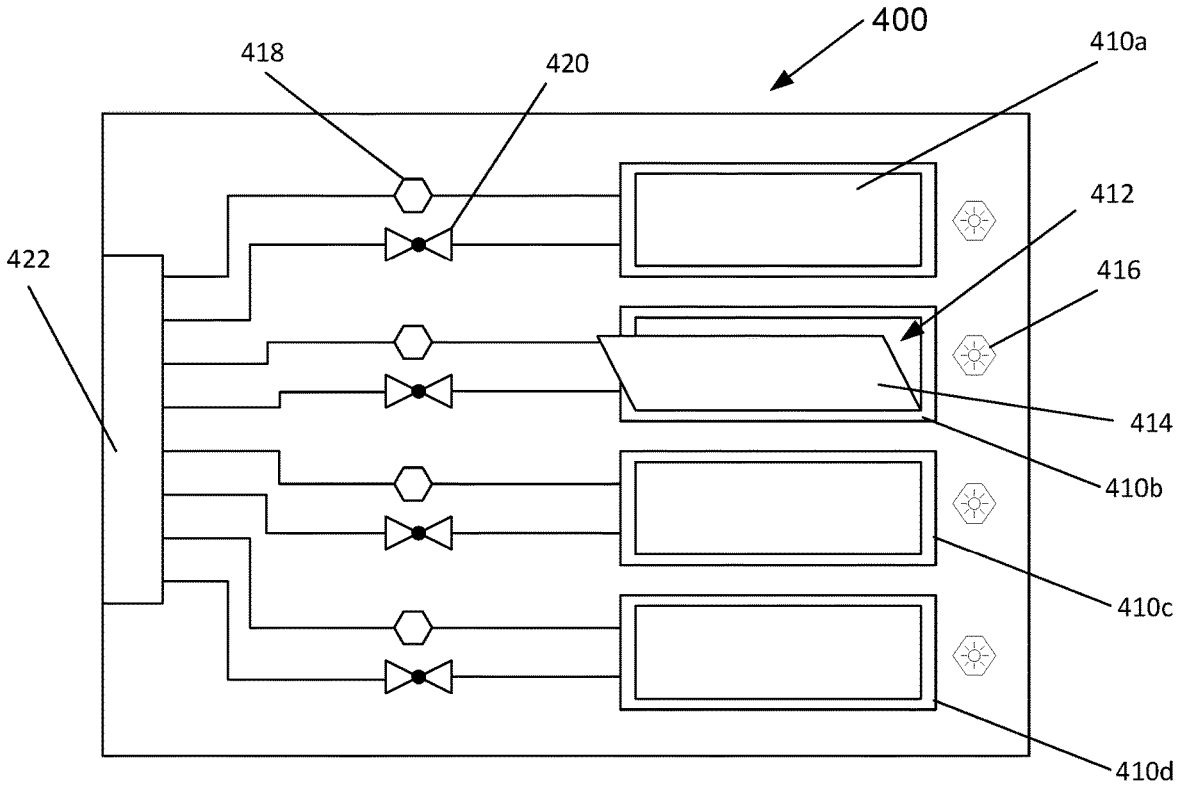
FIG. 4 illustrates an example consumable storage unit.

Referring now to FIG. 4, an example consumable storage unit is illustrated. The example consumable storage unit 400 of FIG. 4 may be a stand-alone accessory that can communicate with an imaging device (not shown in FIG. 4). As illustrated in FIG. 4, the example consumable storage unit 400 includes at least one storage slot 410*a-d* for storage of a replacement consumable. In the example of FIG. 4, the example consumable storage unit 400 is provided with four storage slots 410*a-d*. Other examples may include any other number of storage slots 410*a-d* as desired.

Each storage slot 410*a-d* includes a cavity 412 to store a replacement consumable therein. As noted above, the cavity 412 may be sized to store a replacement consumable associated with a desired imaging device. For example, the size of the cavity 412 may correspond to the size of an ink cartridge for a specific imaging device.

Each storage slot 410*a-d* is provided with a door 414 to control access to a corresponding cavity 412. As noted above, in various examples, the door 414 is lockable to control access.

In some examples, an indicator 416 is provided for each storage slot 412*a-d*. As noted above, the indicator 416 may be a light-emitting diode (LED) or another type of light. The indicator 416 may indicate the presence or absence of a replacement consumable in each storage slot 412*a-d* by, for example, changing color or turning on/off.

Each storage slot 412*a-d* is provided with a sensor 418. In various examples, the sensor 418 may detect the absence or presence of a replacement cartridge in the corresponding storage slot 412*a-d*. Accordingly, the sensor 418 may control operation of the indicator 416. In various examples, the sensor 412*a-d*, in addition to detecting absence or presence of a replacement consumable, may also detect the identity of any replacement consumable in the corresponding storage slot 412*a-d*. For example, as noted above, the sensor 418 may detect the color ink of a replacement ink cartridge in the storage slot 412*a-d*. In this regard, the sensor 418 may include a bar code reader that may read a bar code, or other identifier, on the replacement consumable.

In the example consumable storage unit 400 of FIG. 4, each storage slot 412*a-d* is provided with an actuator 420. The actuator 420 may be provided to selectively open the door 414 of the corresponding storage slot 412*a-d* to allow access to a replacement consumable stored therein. In various examples, the actuator 420 may include a motor, for example, to actuate the door 414.

The example consumable storage unit 400 is provide with a communication interface 422. The communication interface 422 may allow the example consumable storage unit 400 to interface with an imaging device or a controller of the imaging device, as described above with reference to FIGS. 1-3, for example. As noted above, the communication interface 422 may be a wireless interface or a wired interface. The communication interface 422 is coupled to the sensor 418 and actuator 420 corresponding to each storage slot 412*a-d*. In various examples, the communication interface 422 may be directly coupled to the sensors 418 and actuators 420. In other examples, another component (e.g., a controller or multiplexer) may be provided between the communication interface 422 and the various sensors 418 and actuators 420.

The communication interface 422 may allow transmitting of signals from the example consumable storage unit 400 to, for example, an imaging device. For example, the communication interface 422 may transmit signals indicative of input from the sensors 418 to provide information to the imaging device related to the contents of the various storage slots 412*a-d*. Further, the communication interface 422 may allow receiving of signals from an imaging device. For example, the communication interface 422 may receive signals to control the actuators 420 to selectively allow access to the storage slots 412*a-d* and the contents stored therein.

Figure 5:
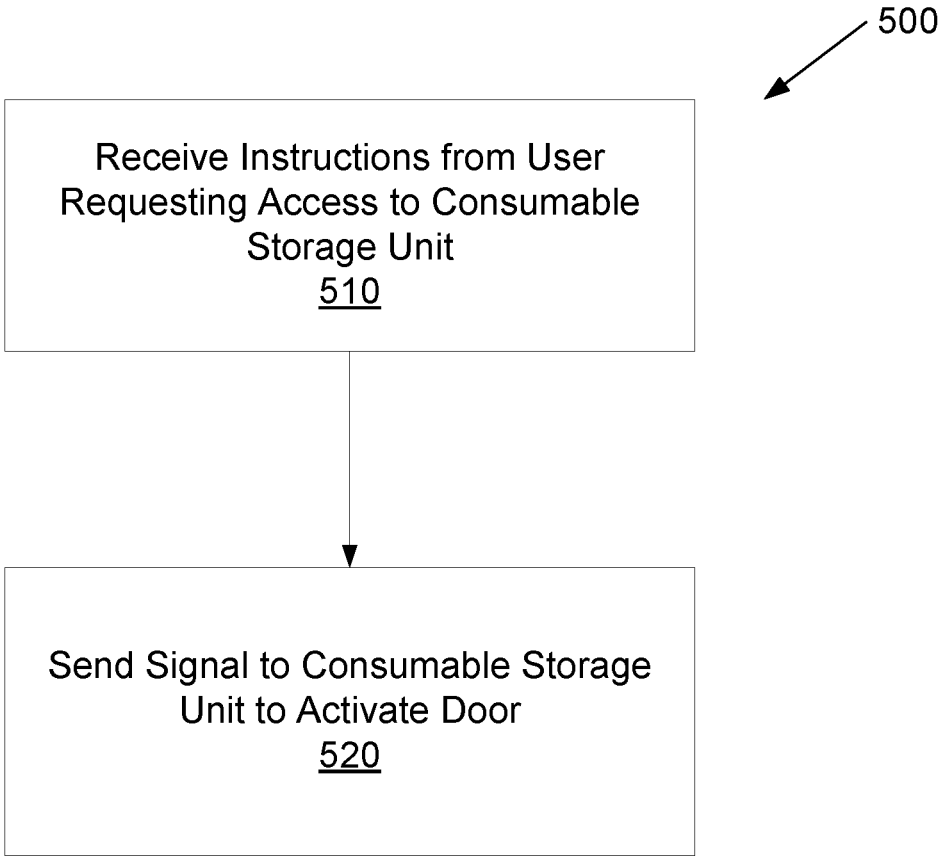
FIG. 5 is a flow chart illustrating an example method for consumable storage access.

Referring now to FIG. 5, a flow chart illustrates an example method for consumable storage access. The example method 500 may be implemented in various systems, including the example systems described above with reference to FIGS. 1-4. In accordance with the example method 500, an imaging device may receive instructions from a user requesting access to a consumable storage unit (block 510). As noted above, in various examples, a consumable storage unit may include at least one cavity to store a replacement consumable therein. The consumable storage unit may include a door to control access to the at least one cavity.

In various examples, the imaging device may determine the authorization of a user to access the consumable storage unit. For example, the imaging device may determine whether the user is properly credentialed to access the consumable storage unit.

Referring again to FIG. 5, the example method 500 further includes sending a signal from the imaging device to the consumable storage unit to activate the door (block 520). In this regard, the imaging device may send a signal to cause an actuator to be activated, resulting in opening of one or more doors. Thus, access to the at least one cavity may be provided.

Software implementations of various examples can be accomplished with standard programming techniques with rule-based logic and other logic to accomplish various database searching steps or processes, correlation steps or processes, comparison steps or processes and decision steps or processes.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system, comprising:

an imaging device, comprising:

at least one consumable used in operation of the imaging device; and a controller; and a consumable storage unit including at least one cavity to store a replacement consumable therein, the replacement consumable being inaccessible for use in operation of the imaging device, wherein the controller is communicatively coupled to the consumable storage unit to receive a signal indicative of presence or absence of replacement consumable in the consumable storage unit.

2. The system of claim 1, wherein the consumable storage unit includes a door to control access to the at least one cavity.

3. The system of claim 2, wherein operation of the door is controlled by the controller.

4. The system of claim 3, wherein the imaging device includes a user interface to allow a user to access the door through the controller.

5. The system of claim 3, wherein controller is communicatively coupled to an electronic device and allows a user of the electronic device to access the door.

6. The system of claim 1, wherein the consumable storage unit is integrally formed with the imaging device.

7. The system of claim 1, wherein the consumable storage unit is a stand-alone unit separate from the imaging device.

8. The system of claim 1, wherein the consumable storage unit includes at least one indicator to indicate presence or absence of replacement consumable in the consumable storage unit.

9. A method, comprising:

receiving, by an imaging device, instructions from a user requesting access to a consumable storage unit, the consumable storage unit including at least one cavity to store a replacement consumable therein, the consumable storage unit further including a door to control access to the at least one cavity;

sending a signal to the consumable storage unit to activate the door to allow access to the at least one cavity.

10. The method of claim 9, further comprising:

determining authorization of the user to access the consumable storage unit before sending the signal to the consumable storage unit.

11. The method of claim 9, further comprising:

receiving a signal from the consumable storage unit indicating presence or absence of replacement consumable within the cavity.

12. The method of claim 9, wherein the instructions from the user are received through a user interface of the imaging device, wherein sending the signal to the consumable storage unit includes sending the signal to an actuator of the consumable storage unit to activate the actuator and unlock the door.

13. The method of claim 9, wherein the instructions from the user are received from a user of an electronic device, wherein the replacement consumable is a replacement for a consumable used in operation of the imaging device.

14. A device, comprising:

at least one cavity to store a replacement consumable therein;

a door to control access to the cavity;

a sensor to detect presence or absence of the replacement consumable within the cavity;

an actuator to selectively open the door; and an interface to transmit signals from the sensor and to receive signals to control the actuator to selectively open the door.

15. The device of claim 14, wherein the interface is to receive and transmit wireless signals, and the actuator is to selectively open the door by unlocking the door in response to the received signals.

16. The device of claim 14, wherein the replacement consumable is a replacement for a consumable used in operation of an imaging device, the replacement consumable being inaccessible for use in operation of the imaging device.

17. The device of claim 14, wherein the door includes a lockable door to control the access to the cavity by the actuator, and wherein, in response to the received signals, the actuator is to:

lock the lockable door such that access to the replacement consumable is restricted; and unlock the lockable door to selectively open the door.

18. The device of claim 14, further including an indicator to provide an indication of the presence or absence of the replacement consumable within the cavity in response to the detection by the sensor.

19. The method of claim 9, further including selectively unlocking the door to provide access to the cavity, wherein the replacement consumable is inaccessible when the door is locked.

20. The method of claim 9, wherein the replacement consumable is a replacement for a consumable used in operation of the imaging device, and the method further includes restricting access to the replacement consumable such that the replacement consumable is inaccessible for use in operation of the imaging device.

* * * * *